US009039144B2

(12) United States Patent
Umeda

(10) Patent No.: US 9,039,144 B2
(45) Date of Patent: May 26, 2015

(54) BASE, FULL-LINE PRINTHEAD, AND PRINTING APPARATUS

(71) Applicant: CANON KABUSHIKI KAISHA, Tokyo (JP)

(72) Inventor: Kengo Umeda, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/244,168

(22) Filed: Apr. 3, 2014

(65) Prior Publication Data

US 2014/0327715 A1 Nov. 6, 2014

(30) Foreign Application Priority Data

May 1, 2013 (JP) ..... 2013-096642

(51) Int. Cl.
*B41J 2/14* (2006.01)
*B41J 29/38* (2006.01)
*B41J 2/115* (2006.01)

(52) U.S. Cl.
CPC ..... *B41J 2/115* (2013.01)

(58) Field of Classification Search
USPC ..... 347/9, 10, 11, 13, 50
See application file for complete search history.

(56) References Cited

U.S. PATENT DOCUMENTS

| | | | | |
|---|---|---|---|---|
| 8,197,039 | B2 | 6/2012 | Inoue | |
| 2008/0259104 | A1 * | 10/2008 | Nishihara | 347/7 |
| 2012/0127239 | A1 * | 5/2012 | Maruyama et al. | 347/50 |
| 2012/0162317 | A1 | 6/2012 | Hirayama et al. | |

FOREIGN PATENT DOCUMENTS

JP 2011-046160 A 3/2011

* cited by examiner

*Primary Examiner* — Jannelle M Lebron
(74) *Attorney, Agent, or Firm* — Fitzpatrick, Cella, Harper & Scinto

(57) ABSTRACT

A full-line printhead includes a base in which a plurality of substrates each including arrayed print elements are arranged in the arrayed direction has the following arrangement. The base includes a terminal for inputting a first differential signal, a first pair of lines for transferring the first differential signal from the terminal to the substrates, a terminal for inputting a second differential signal, and a second pair of lines for transferring the second differential signal from the terminal to the substrates. Each substrate includes a first amplifier for amplifying the first differential signal transferred via the first pair of lines, and a second amplifier for amplifying the second differential signal transferred via the second pair of lines. Control is performed to change the gain of the first amplifier based on a control signal from outside.

10 Claims, 10 Drawing Sheets

BASE, FULL-LINE PRINTHEAD, AND PRINTING APPARATUS

BACKGROUND OF THE INVENTION

1. Field of the Invention

The present invention relates to a base, a full-line printhead, and a printing apparatus and, more particularly, to a full-line printhead that performs printing in accordance with, for example, an inkjet method and a printing apparatus that performs printing using the same.

2. Description of the Related Art

The element substrate of a printhead included in an inkjet printing apparatus (to be referred to as a printing apparatus hereinafter) is formed from a semiconductor integrated circuit. To implement printing at a higher speed, there has been proposed a full-line printhead in which a plurality of element substrates are arranged to obtain a print width equal to or more than the width of a print medium in advance. For example, Japanese Patent Laid-Open No. 2011-046160 discloses such a full-line printhead.

As a clock signal (CLK) used to supply an image data signal (DATA) or a latch signal (LT) to the element substrates of a full-line printhead, a signal common to the plurality of element substrates is used. Hence, from the viewpoint of the wiring space of a printed board on which the plurality of element substrates are integrated, the clock signal is supplied using one-to-many connection (multidrop connection). On the other hand, the element substrates use individual image data signals (DATA). Hence, the image data signals are supplied using one-to-one connection (point-to-point connection).

Since the image data signals are supplied by one-to-one connection, a high waveform quality is obtained in all element substrates. However, the clock signal that is supplied using one-to-many connection causes multiple reflection because the plurality of element substrates are connected. The waveform of the clock signal supplied to an element substrate far apart from the terminating resistor has a deteriorated quality as compared to the waveform of the clock signal supplied to an element substrate close to the terminating resistor. In addition, the signal amplitude becomes small. For this reason, in the element substrate arranged far apart from the terminating resistor, a signal amplitude difference between the image data signal and the clock signal occurs. When the signal amplitude is small, the rise and fall of a single-ended signal after amplification by a reception circuit that receives the signal become blunt. Hence, when an amplitude difference between the image data signal and the clock signal occurs, it results in a difference between the rise and fall of the single-ended signal after amplification by the reception circuit.

FIG. 13 is a view showing the single-ended waveforms of the image data signal (DATA) and the clock signal (CLK) after amplification by reception circuits provided in a plurality of element substrates integrated on a conventional full-line printhead.

As is apparent from FIG. 13, in an element substrate 101-1 close to a terminating resistor, the image data signal (DATA) and the clock signal (CLK) have no amplitude difference. For this reason, no difference between the rise and fall of the single-ended waveform after amplification by the reception circuit occurs. To the contrary, in an element substrate 101-4 far apart from the terminating resistor, an amplitude difference between the image data signal (DATA) and the clock signal (CLK) occurs. For this reason, it results in a difference between the rise and fall of the single-ended waveform after amplification by the reception circuit. As a consequence, the margin of Setup/Hold time of the image data signal and the clock signal becomes small, and the element substrate might be no longer able to receive a correct data signal.

SUMMARY OF THE INVENTION

Accordingly, the present invention is conceived as a response to the above-described disadvantages of the conventional art.

For example, a base, a full-line printhead, and a printing apparatus according to this invention are capable of making the waveform quality of a signal of one-to-one connection and that of a signal of one-to-many connection coincide with each other and ensuring a sufficient margin of Setup/Hold time.

According to one aspect of the present invention, there is provided a base in which a plurality of element substrates each including a plurality of driving elements are arranged in an arrayed direction of the plurality of driving elements. The base comprises: a first terminal configured to input a first signal as a differential signal; a first pair of signal lines configured to transfer the differential signal of the first signal from the first terminal to the plurality of element substrates; a second terminal configured to input a second signal as a differential signal; and a second pair of signal lines configured to transfer the differential signal of the second signal from the second terminal to the plurality of element substrates. Each of the plurality of element substrates includes: a first amplifier configured to amplify the differential signal of the first signal transferred via the first pair of signal lines; a second amplifier configured to amplify the differential signal of the second signal transferred via the second pair of signal lines; and a first control circuit configured to control to change a gain of the first amplifier based on a first control signal from outside.

According to another aspect of the present invention, there is provided a full-line printhead configured to use a base having the above-described arrangement. More specifically, each of a plurality of driving elements serves as a print element, a first signal is used as a clock signal, and a second signal is used as an image data signal so as to cause the plurality of print elements to perform printing in a printing width corresponding to a width of a print medium.

According to still another aspect of the present invention, there is provided a printing apparatus using a full-line printhead having the above-described arrangement and, more particularly, an inkjet printhead configured to perform printing by discharging ink in accordance with an inkjet method.

The invention is particularly advantageous since the waveform quality of a signal of one-to-one connection can be made to coincide with that of a signal of one-to-many connection by changing the gain of an amplifier that receives and amplifies a differential signal, and therefore, a sufficient margin of Setup/Hold time of each signal can be ensured. This allows each element substrate to receive a correct data signal and achieves an excellent operation.

Further features of the present invention will become apparent from the following description of exemplary embodiments (with reference to the attached drawings).

DESCRIPTION OF THE EMBODIMENTS

Figure 1:
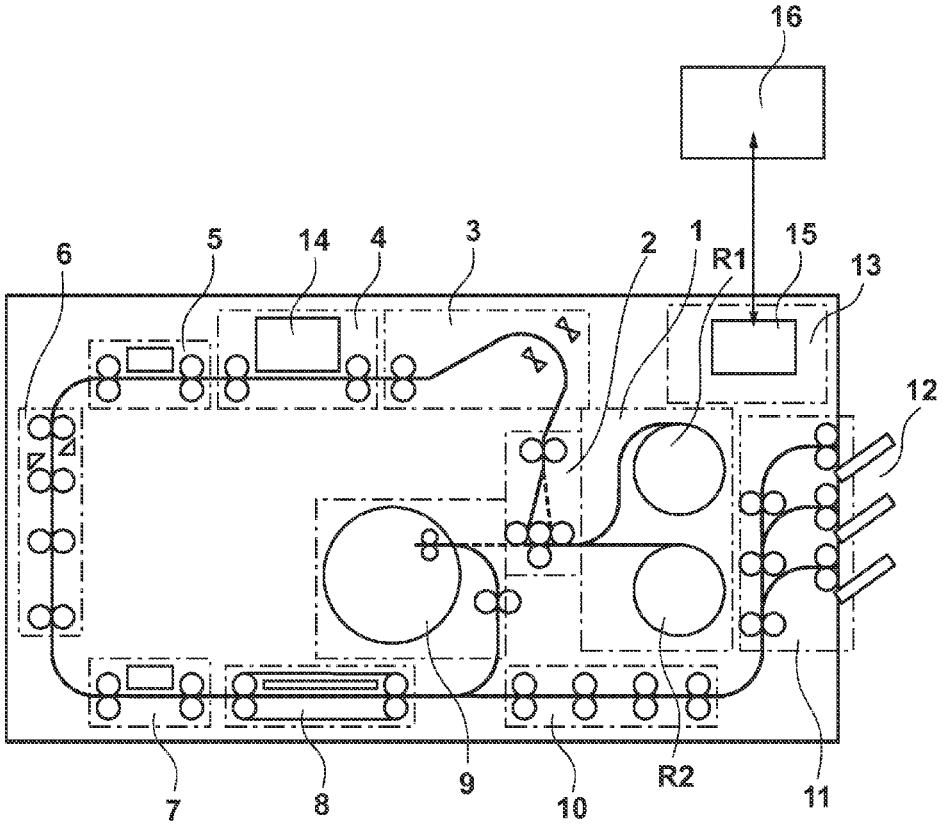
FIG. 1 is a schematic side sectional view showing the internal arrangement of an inkjet printing apparatus according to an exemplary embodiment of the present invention.

Exemplary embodiments of the present invention will now be described in detail in accordance with the accompanying drawings. Note that the same reference numerals denote already explained parts, and a repetitive description thereof will be omitted.

In this specification, the terms "print" and "printing" not only include the formation of significant information such as characters and graphics, but also broadly includes the formation of images, figures, patterns, and the like on a print medium, or the processing of the medium, regardless of whether they are significant or insignificant and whether they are so visualized as to be visually perceivable by humans.

Also, the term "print medium" not only includes a paper sheet used in common printing apparatuses, but also broadly includes materials, such as cloth, a plastic film, a metal plate, glass, ceramics, wood, and leather, capable of accepting ink.

Furthermore, the term "ink" (to be also referred to as a "liquid" hereinafter) should be extensively interpreted similar to the definition of "print" described above. That is, "ink" includes a liquid which, when applied onto a print medium, can form images, figures, patterns, and the like, can process the print medium, and can process ink. The process of ink includes, for example, solidifying or insolubilizing a coloring agent contained in ink applied to the print medium.

Further, a "nozzle" generically means an ink orifice or a liquid channel communicating with it, and an element for generating energy used to discharge ink, unless otherwise specified.

An element substrate (head substrate) for a printhead to be used below indicates not a mere base made of silicon semiconductor but a component provided with elements, wirings, and the like.

"On the substrate" not only simply indicates above the element substrate but also indicates the surface of the element substrate and the inner side of the element substrate near the surface. In the present invention, "built-in" is a term not indicating simply arranging separate elements on the substrate surface as separate members but indicating integrally forming and manufacturing the respective elements on the element substrate in, for example, a semiconductor circuit manufacturing process.

An embodiment of an inkjet printing apparatus will be described next. This printing apparatus is a high-speed line printer that uses a continuous sheet (print medium) wound into a roll and supports both single-sided printing and double-sided printing. The printing apparatus is suitable for, for example, a mass print field in a print laboratory or the like.

FIG. 1 is a side sectional view showing the schematic internal arrangement of an inkjet printing apparatus (to be referred to as a printing apparatus hereinafter) according to an exemplary embodiment of the present invention. The interior of the apparatus can roughly be divided into a sheet supply unit 1, a decurling unit 2, a skew adjustment unit 3, a print unit 4, a cleaning unit (not shown), an inspection unit 5, a cutter unit 6, an information printing unit 7, a drying unit 8, a sheet winding unit 9, a discharge conveyance unit 10, a sorter unit 11, a discharge tray 12, a control unit 13, and the like. A sheet is conveyed by a conveyance mechanism including roller pairs and a belt along a sheet conveyance path indicated by the solid line in FIG. 1 and undergoes processing of each unit.

The sheet supply unit 1 stores and supplies a continuous sheet wound into a roll. The sheet supply unit 1 can store two rolls R1 and R2, and is configured to selectively draw and supply a sheet. Note that the number of storable rolls is not limited to two, and one or three or more rolls may be stored. The decurling unit 2 reduces the curl (warp) of the sheet supplied from the sheet supply unit 1. The decurling unit 2 bends and strokes the sheet so as to give a warp in an opposite direction to the curl using two pinch rollers with respect to one driving roller, thereby reducing the curl. The skew adjustment unit 3 adjusts the skew (tilt with respect to the original traveling direction) of the sheet that has passed through the decurling unit 2. A sheet end on a reference side is pressed against a guide member, thereby adjusting the skew of the sheet.

The print unit 4 forms an image on the conveyed sheet by a printhead unit 14. The print unit 4 also includes a plurality of conveyance rollers configured to convey the sheet. The printhead unit 14 includes a full-line printhead (inkjet printhead) in which an inkjet nozzle array is formed within a range covering the maximum width of sheets assumed to be used. In the printhead unit 14, a plurality of printheads are arranged parallelly along the sheet conveyance direction. In this embodiment, the printhead unit 14 includes four printheads corresponding to four colors of K (black), C (cyan), M (magenta), and Y (yellow). The printheads are arranged in the order of K, C, M, and Y from the upstream side of sheet conveyance. Note that the number of ink colors and the number of printheads are not limited to four. As the inkjet method, a method using heating elements, a method using piezoelectric elements, a method using electrostatic elements, a method using MEMS elements, or the like can be employed. The respective color inks are supplied from ink tanks to the printhead unit 14 via ink tubes.

The inspection unit 5 optically reads an inspection pattern or image printed on the sheet by the print unit 4, and inspects the states of nozzles of the printheads, the sheet conveyance state, the image position, and the like. The inspection unit 5 includes a scanner unit that actually reads an image and generates image data, and an image analysis unit that analyzes the read image and returns the analysis result to the print unit 4. The inspection unit 5 includes a CCD line sensor which is arranged in a direction perpendicular to the sheet conveyance direction.

Figure 2:
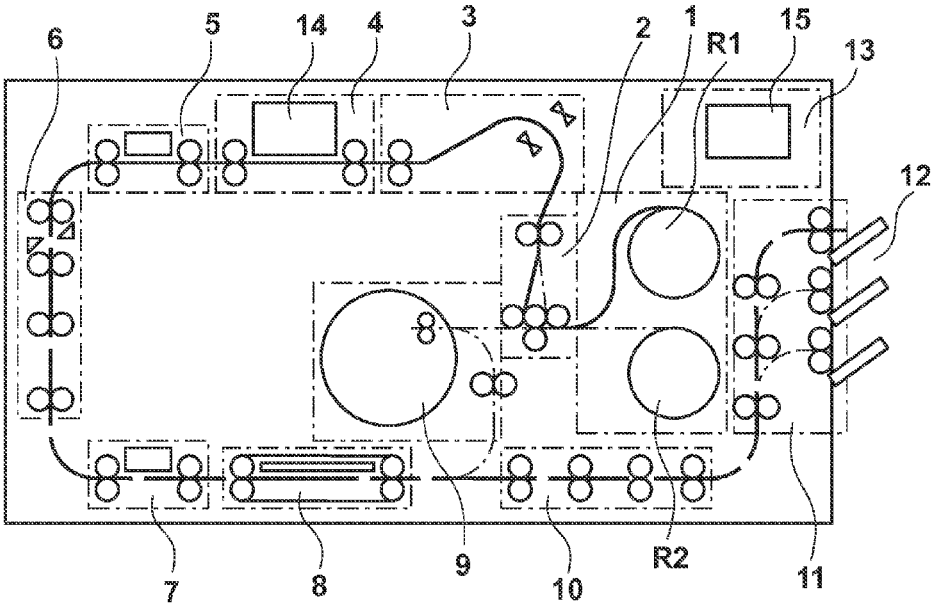
FIG. 2 is a view for explaining the single-sided printing operation of the printing apparatus shown in FIG. 1.
Figure 3:
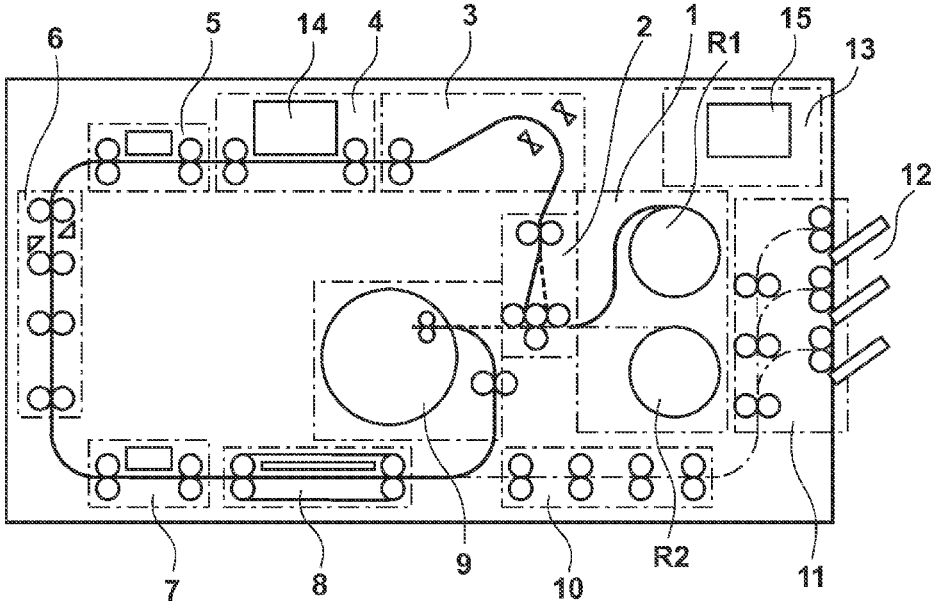
FIG. 3 is a view for explaining the double-sided printing operation of the printing apparatus shown in FIG. 1.

Note that the printing apparatus shown in FIG. 1 supports both single-sided printing and double-sided printing, as described above. FIGS. 2 and 3 are views for explaining the single-sided printing operation and double-sided printing operation of the printing apparatus shown in FIG. 1, respectively.

Figure 4:
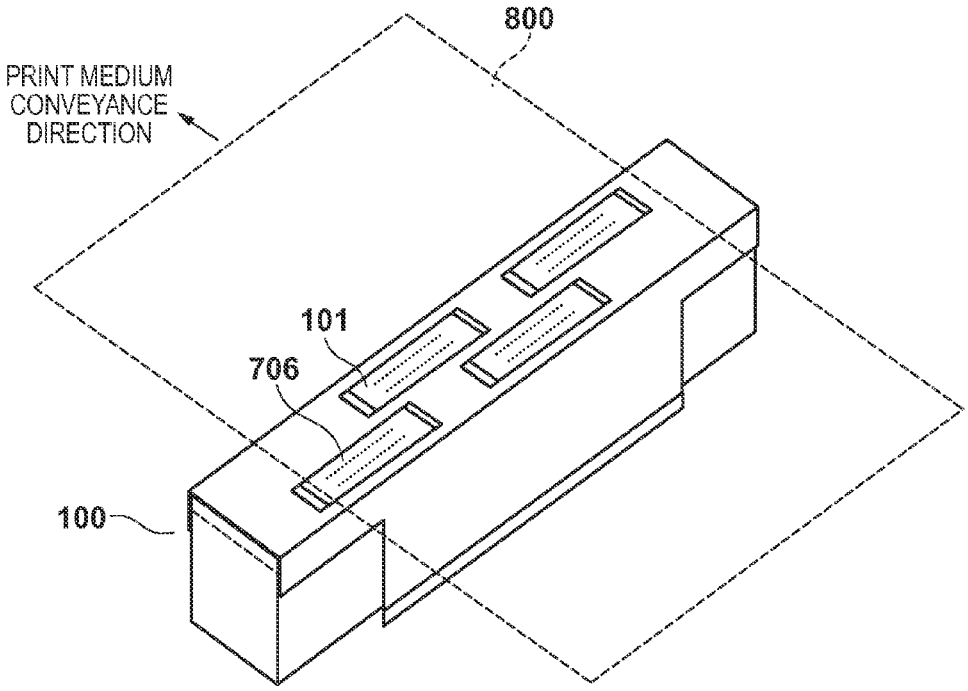
FIG. 4 is a perspective view of a full-line printhead.

FIG. 4 is a view showing the relationship between a full-line printhead 100 included in the printhead unit 14 and the conveyance direction of a print medium 800.

When performing a printing operation, the full-line printhead 100 is fixed on the printing apparatus, the print medium 800 is conveyed, and the inks are discharged from a plurality of orifices 706 provided in element substrates 101, thereby forming an image on the print medium 800.

As is apparent from FIG. 4, in this example, the full-line printhead 100 is formed by integrating four element substrates 101.

Figure 5:
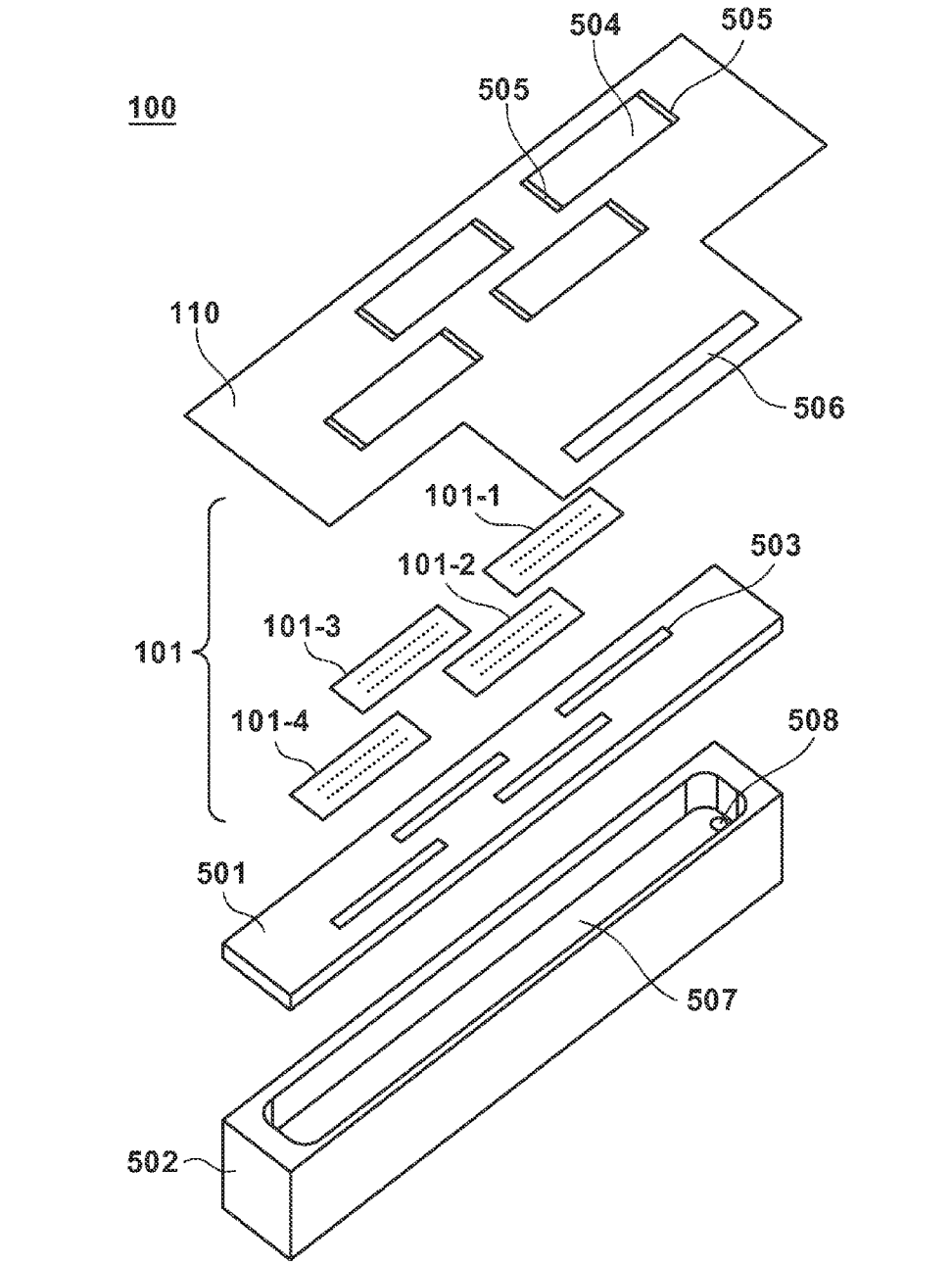
FIG. 5 is an exploded perspective view of the full-line printhead.

FIG. 5 is an exploded perspective view of the full-line printhead.

The full-line printhead 100 includes four element substrates 101-1, 101-2, 101-3, and 101-4, a support member 501, a printed board 110, and an ink supply member 502. As shown in FIG. 5, the four element substrates are arranged zigzag in the full-line printhead 100. Note that a printhead having a larger print width can be formed by increasing the number of element substrates 101 included. When explaining the four element substrates without individually specifying them, they will simply be referred to as element substrates 101.

As is apparent from FIG. 5, the printed board 110 basically has a rectangular shape, and the element substrates 101 have a rectangular shape. The plurality of orifices 706 are arrayed in the longitudinal direction of the element substrates 101. The element substrates 101 are arranged such that their longitudinal direction, that is, the arrayed direction of the plurality of orifices coincides with the longitudinal direction of the printed board 110.

Figure 6A:
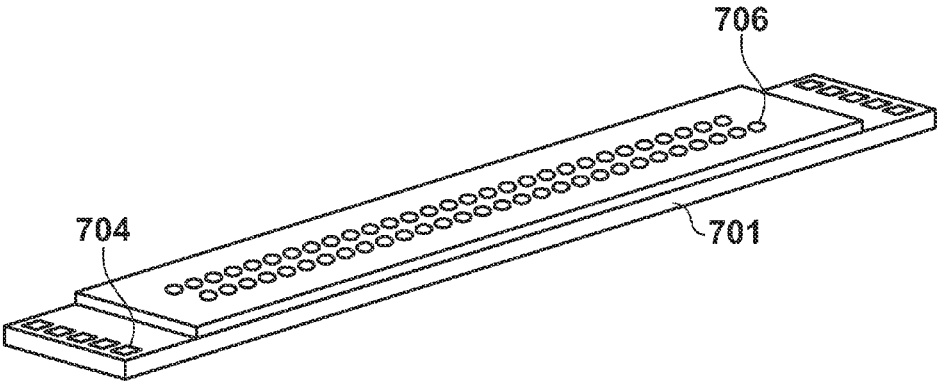
FIGS. 6A and 6B are perspective views and a cross section, respectively, showing the structure of one element substrate.
Figure 6B:
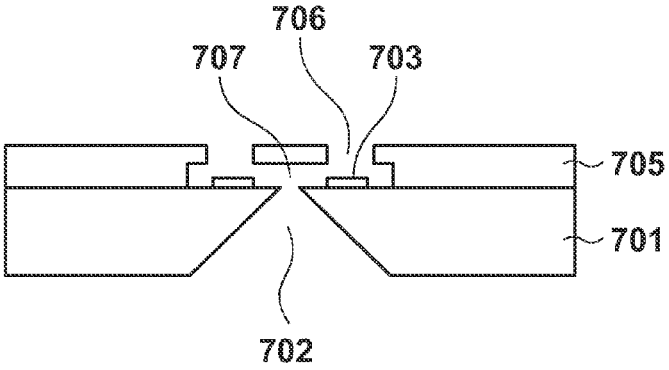

FIGS. 6A and 6B are a perspective view and a cross section, respectively, showing the structure of one element substrate.

An element substrate is used to discharge ink. As shown in the cross section of FIG. 6B, a long groove-shaped ink supply aperture 702 is accurately formed in an Si substrate 701 having a thickness of 0.05 to 0.625 mm by wet etching, dry etching, or the like.

A plurality of heaters 703 serving as print elements on both sides of the ink supply aperture 702 and a driving circuit configured to drive the heaters 703 at predetermined positions for a predetermined time are formed on the surface of the Si substrate 701 by a film forming technique. As shown in the perspective view of FIG. 6A, input terminals 704 to be electrically connected to the printed board 110 are formed at both ends of the element substrate 101 in the longitudinal direction. An orifice forming member 705 made of a resin material is formed on the Si substrate 701. The plurality of orifices 706 corresponding to the heaters 703 and an ink reservoir 707 communicating with the orifices are formed by photolithography.

Referring back to FIG. 5, the support member 501 is a member configured to support and fix the element substrates 101, and is made of, for example, alumina ($Al_2O_3$) having a thickness of 0.5 to 10 mm. Note that the material of the support member 501 is not limited to alumina, and the support member 501 may be made of a high rigidity material having the same linear expansion coefficient as that of the element substrates 101. Examples of the material are silicon (Si), aluminum nitride (AlN), zirconia, silicon nitride ($Si_3N_4$), silicon carbide (SiC), molybdenum (Mo), and tungsten (W).

Ink supply apertures 503 are formed in the support member 501 at positions corresponding to the ink supply apertures 702 of the element substrates 101. The element substrates 101 are adhered and fixed to the support member 501 by an adhesive with a high accuracy of position.

The printed board 110 is a member configured to transfer and supply an electrical signal and power supply voltage to discharge the inks to the element substrates 101. For example, a flexible substrate having a two-layered structure including wirings formed on both sides of a base and surface layers covered with protective films is used.

As shown in FIG. 5, opening portions 504 to integrate the element substrates 101 are formed in the printed board 110. The printed board 110 includes terminals 505 corresponding to the input terminals 704 of the element substrates 101, and a terminal 506 (for example, connector) configured to receive an electrical signal from the printing apparatus main body.

The printed board 110 is adhered and fixed, by an adhesive, to the same surface of the support member 501 as the surface where the element substrates 101 are adhered. The gaps between the opening portions 504 and the element substrates 101 are sealed by a sealant. The terminals 505 of the printed board 110 and the input terminals 704 of the element substrates 101 are electrically connected by, for example, a wire bonding technique using gold wires, and the electrical connection portions are sealed by a sealant. The printed board 110 is bent and fixed on both side surfaces of the support member 501 so as to easily obtain electrical connection with the main body.

The ink supply member 502 is a component configured to supply inks from the ink tanks to the element substrates 101, and is formed by, for example, injection forming using a resin material. An ink reservoir 507 configured to supply inks to the plurality of element substrates 101 is formed in the ink supply member 502. Ink is introduced from an opening portion 508 to the ink reservoir 507 via an ink supply tube from an ink tank. The ink supply member 502 is joined to the support member 501.

Several embodiments of the full-line printhead included in the printing apparatus having the above-described arrangement will be described next.

First Embodiment

Figure 7:
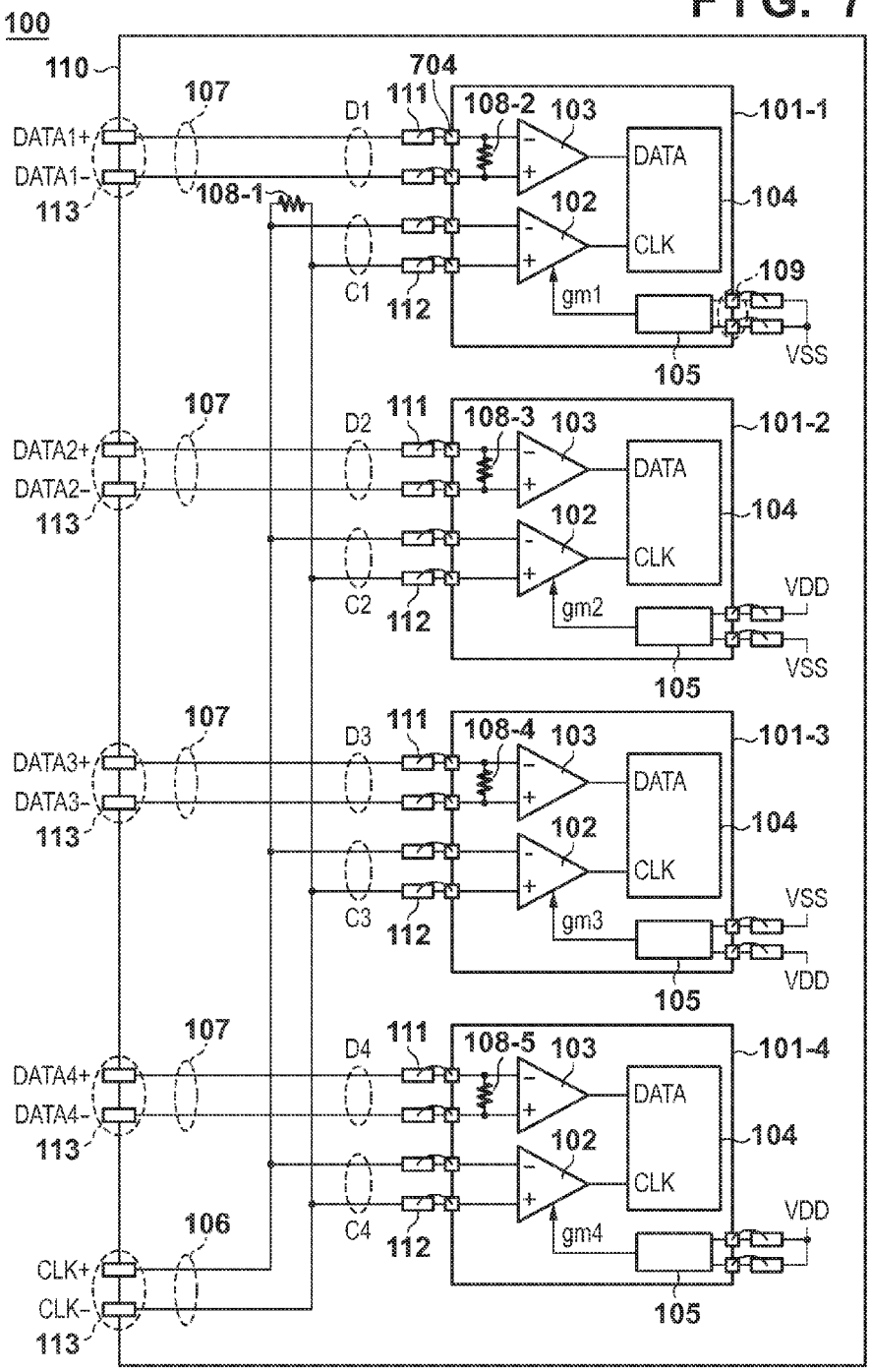
FIG. 7 is a circuit diagram showing the circuit layout and wiring of four element substrates integrated on a printed board according to the first embodiment.

FIG. 7 is a circuit diagram showing the circuit layout and wiring of four element substrates integrated on a printed board 110.

As shown in FIG. 7, four element substrates 101 are arranged on the printed board 110. A first pair of signal lines 106 configured to supply a clock signal (CLK) and four second pairs of signal lines 107 configured to supply image data signals (DATA) are formed on the printed board 110. Note that the printed board 110 is also called a base because a plurality of element substrates are arranged and integrated on it.

The first pair of signal lines 106 supply a common signal to the element substrates and therefore form one-to-many connection from the viewpoint of the wiring space of the printed board. On the other hand, the four second pairs of signal lines 107 form one-to-one connection because the element substrates use individual signals. The first pair of signal lines 106 are terminated by a terminating resistor 108-1. The second pairs of signal lines 107 are terminated by terminating resistors 108-2, 108-3, 108-4, and 108-5. The printed board 110 includes terminals 113 that connect the first pair of signal lines 106 and the four second pairs of signal lines 107.

The four element substrates are circuits having the same arrangement. The arrangement will be described below.

The element substrate 101 includes a first reception circuit 102, a second reception circuit 103, a driving circuit 104, a control circuit 105, a control terminal 109, and terminals (pads) 111 and 112. The driving circuit 104 includes a first input portion configured to input a clock signal (CLK: first signal) and a second input portion configured to input an image data signal (DATA: second signal). The driving circuit 104 drives print elements based on the first signal and the second signal. Each of the first reception circuit 102 and the second reception circuit 103 is formed from a differential amplifier having a certain gain. The differential amplifier amplifies a differential signal having a small amplitude (for example, 350 mV) and converts it into a single-ended signal having a large amplitude (for example, 3.3 V). In FIG. 7, the gains of the four element substrates are represented by gm1, gm2, gm3, and gm4.

The control circuit 105 sets the gain of the first reception circuit 102 based on a 2-bit signal input to the control terminal 109. For example, when the logical levels of the two bits of the signal input from the control terminal 109 are low level, the gain of the first reception circuit 102 is set to the lowest gain (first level). When the LSB of the 2-bit signal is high level, and the MSB is low level, the gain of the first reception circuit 102 is set to the second lowest gain (second level). When the LSB is low level, and the MSB is high level, the gain of the first reception circuit 102 is set to the second highest gain (third level). When the two bits are high level, the gain of the first reception circuit 102 is set to the highest gain (fourth level). In this way, the control circuit 105 can set the gain of the first reception circuit 102 in four levels in accordance with the signals input to the control terminal 109. In other words, the control circuit 105 can be regarded as a setting circuit configured to determine the gain of the first reception circuit 102.

Since the plurality of (in this case, four) element substrates 101 are connected, the first pair of signal lines 106 configured to supply the clock signal (CLK) of one-to-many connection causes multiple reflection of the signal. Hence, the waveform quality deteriorates, and the signal amplitude becomes small. The longer the distance from the terminating resistor 108-1 is, the larger the deterioration of waveform quality caused by the multiple reflection is.

Hence, as is apparent from the layout shown in FIG. 7, the waveform quality of the clock signal deteriorates in the order of the element substrates 101-1, 101-2, 101-3, and 101-4.

Figure 8:
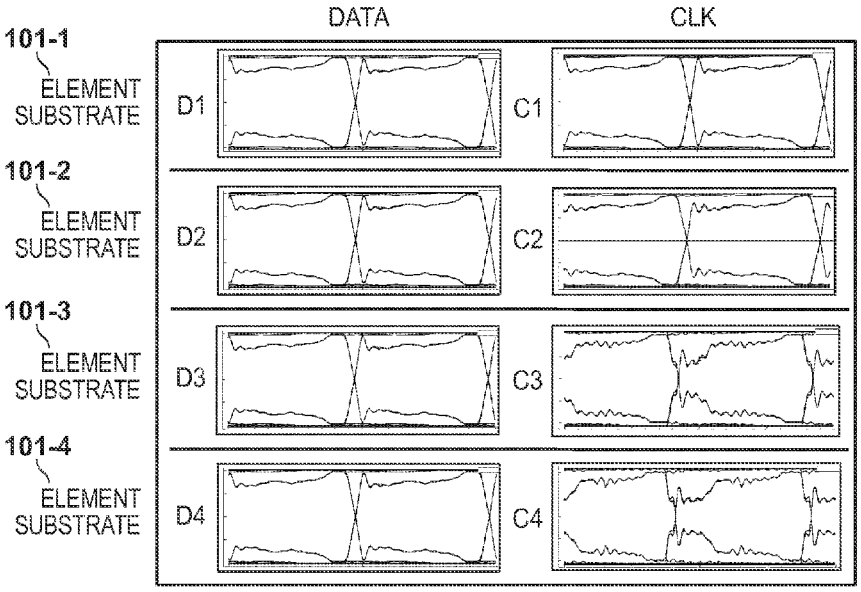
FIG. 8 is a view for explaining the simulation results of the amplitudes of signals.

FIG. 8 is a view showing the simulation results of the amplitudes of the image data signal (DATA) and the clock signal (CLK).

As shown in FIG. 8, in the element substrate 101-1, the clock signal (CLK) has a high waveform quality C1, and its amplitude coincides with that of the image data signal (DATA) because the distance from the terminating resistor 108-1 is short. To the contrary, in the element substrate 101-4 having the longest distance from the terminating resistor 108-1, the clock signal (CLK) has a most deteriorated waveform quality C4, and its amplitude becomes smallest because of the influence of reflection of the element substrates 101-1, 101-2, and 101-3. On the other hand, as for the image data signals (DATA) supplied through the four second pairs of signal lines 107 of one-to-one connection, high waveform qualities D1 to D4 are obtained in all the element substrates because the terminating resistors are connected to the respective element substrates, and multiple reflection does not occur. For these reasons, in the element substrate far apart from the terminating resistor 108-1, an amplitude difference between the clock signal (CLK) and the image data signal (DATA) occurs.

As described above, a 2-bit control signal is input from outside (for example, from the printing apparatus main body) to the control terminal 109 of the control circuit 105 of each of the four element substrates. The control signal can be set to different values in the four element substrates.

In FIG. 7, a signal value "00" is supplied to the control terminal 109 of the element substrate 101-1, a signal value "01" is supplied to the control terminal 109 of the element substrate 101-2, a signal value "10" is supplied to the control terminal 109 of the element substrate 101-3, and a signal value "11" is supplied to the control terminal 109 of the element substrate 101-4. The first bit of the 2-bit value is the MSB, and the last one is the LSB. Because of these signal values, if a signal is high level, its value represents "1", and if a signal is low level, its value represents "0".

Hence, the gain gm1 of the first reception circuit 102 of the element substrate 101-1 is set to the first level, the gain gm2 of the first reception circuit 102 of the element substrate 101-2 is set to the second level, and the gain gm3 of the first reception circuit 102 of the element substrate 101-3 is set to the third level. The gain gm4 of the first reception circuit 102 of the element substrate 101-4 is set to the fourth level. Hence, a relationship gm1<gm2<gm3<gm4 holds. Note that the gain of the second reception circuit 103 is set to the first level in all the element substrates.

Figure 9:
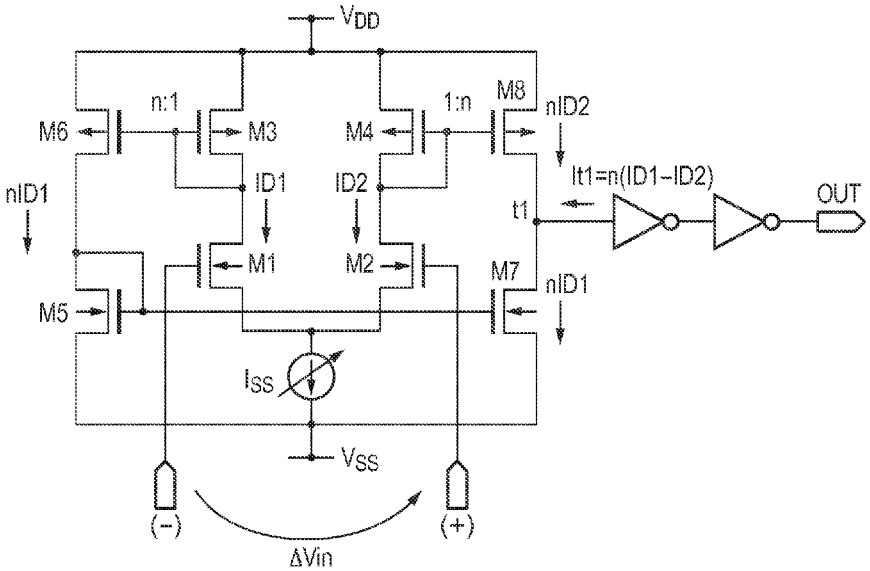
FIG. 9 is a circuit diagram showing an example of the circuit arrangement of first and second reception circuits.

FIG. 9 is a circuit diagram showing the circuit arrangement of the first and second reception circuits.

As is apparent from FIG. 9, each of these reception circuits is formed from a differential amplifier, a current mirror circuit, and a buffer. Let ID1 be the current flowing to a transistor M1, and ID2 be the current flowing to a transistor M2. A current flowing to a terminal t1 is n(ID1-ID2), where n is the current mirror ratio. When the terminal t1 that is the input to the buffer is charged/discharged by the current (ID1-ID2), a differential signal having a small amplitude is converted into a single-ended signal having a large amplitude. Hence, in this circuit arrangement, the rise and fall times of the single-ended signal are determined by the current amount (ID1-ID2).

Note that referring to FIGS. 9, M3, M4, M5, M6, M7, and M8 denote transistors; nID1, a current flowing to the transistors M5 and M7; and nID2, a current flowing to the transistor M8.

As is apparent from the circuit arrangement shown in FIG. 7, the image data signal (DATA) and the clock signal (CLK) are supplied from the printing apparatus main body side as low voltage differential signals (LVDS), although a detailed description thereof has not particularly been made. The differential amplifiers provided in the first and second reception circuits included in the respective element substrates amplify these differential signals into logical signals having a logical level of, for example, 3.3 V.

Figure 10:
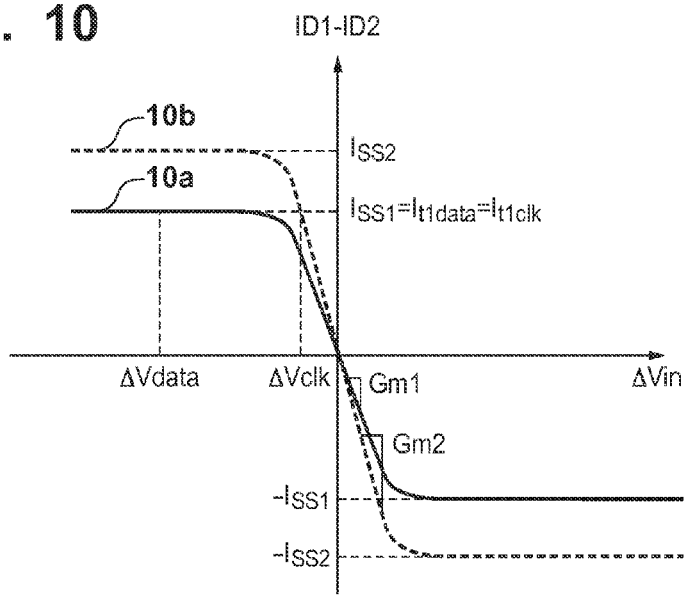
FIG. 10 is a graph for explaining the gains of the first and second reception circuits.

FIG. 10 is a graph showing the relationship between a differential amplitude ΔVin and the current amount (ID1-ID2).

As shown in FIG. 10, the current amount (ID1-ID2) is linear with respect to the differential amplitude ΔVin within a certain range, and is saturated to a tail current $I_{SS}$ when the differential amplitude ΔVin has a predetermined value or more. The gradient in the linear range indicates the gain gm of the reception circuit. The gain gm of the first reception circuit 102 or the second reception circuit 103 can freely be set by, for example, changing the value of the tail current $I_{SS}$.

Referring to FIG. 10, a solid line 10*a* indicates the characteristic of the second reception circuit 103 of the element substrate 101-4 whose gain is set to the first level. The tail current is set to $I_{SS1}$, and the gain is set to Gm1. A broken line 10*b* indicates the characteristic of the first reception circuit 102 of the element substrate 101-4 whose gain is set to the fourth level. The tail current is set to $I_{SS2}$, and the gain is set to Gm2.

In the element substrate 101-4, as described above, the image data signal (DATA) has high waveform quality, but the clock signal (CLK) has deteriorated waveform quality and a small amplitude. Let ΔVdata be the differential amplitude of the image data signal (DATA) received by the second reception circuit 103 of the element substrate 101-4, and $I_{t1data}$ be the current amount (ID1-ID2) at that time. Also, let ΔVclk be the differential amplitude of the clock signal (CLK) received by the first reception circuit 102 of the element substrate 101-4, and $I_{t1clk}$ be the current amount (ID1-ID2) at that time.

As can be seen from FIG. 10, the gain of the first reception circuit 102 is set to be higher than that of the second reception circuit 103. Hence, even when an amplitude difference between the image data signal (DATA) and the clock signal (CLK) occurs, the current value (ID1-ID2) in the first reception circuit 102 can coincide with that in the second reception circuit 103. Hence, as for the amount of the current flowing to the terminal t1 in the first or second reception circuit shown in FIG. 9, the current amount in the first reception circuit 102 can be the same as that in the second reception circuit 103. For this reason, the rise and fall times of the single-ended signal of the image data signal (DATA) can coincide with those of the clock signal (CLK).

Figure 11:
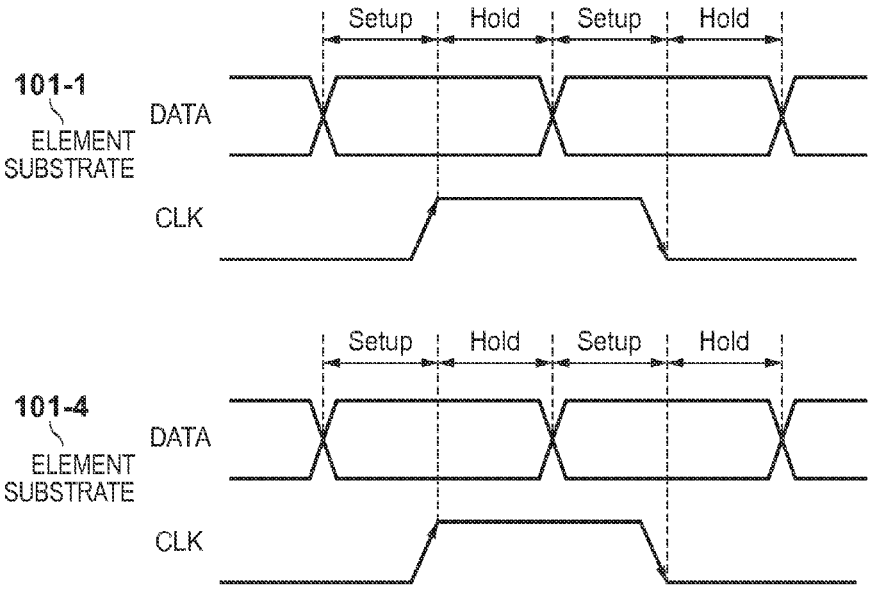
FIG. 11 is a view for explaining signals amplified by the first and second reception circuits.

This allows the element substrates 101-1 and 101-4 to obtain the same waveform quality concerning the image data signal (DATA) and the clock signal (CLK) after amplification by the reception circuits of the element substrates, as shown in FIG. 11. It is therefore possible to sufficiently ensure the margin of Setup/Hold time.

Hence, according to the above-described embodiment, the gain of the first reception circuit of the element substrate is set higher as the distance from the terminating resistor increases, thereby obtaining the same waveform quality concerning the image data signal and the clock signal after amplification by the reception circuits. A sufficient margin of Setup/Hold time of each signal can thus be ensured. For example, in the element substrate 101-4 whose distance from the terminating resistor is longest, the gain of the first reception circuit is set highest. For this reason, even when the amplitude of the clock signal is small, the waveform quality of the amplified clock signal coincides with that of the image data signal. It is therefore possible to sufficiently ensure the margin of Setup/Hold time of each signal.

Second Embodiment

Figure 12:
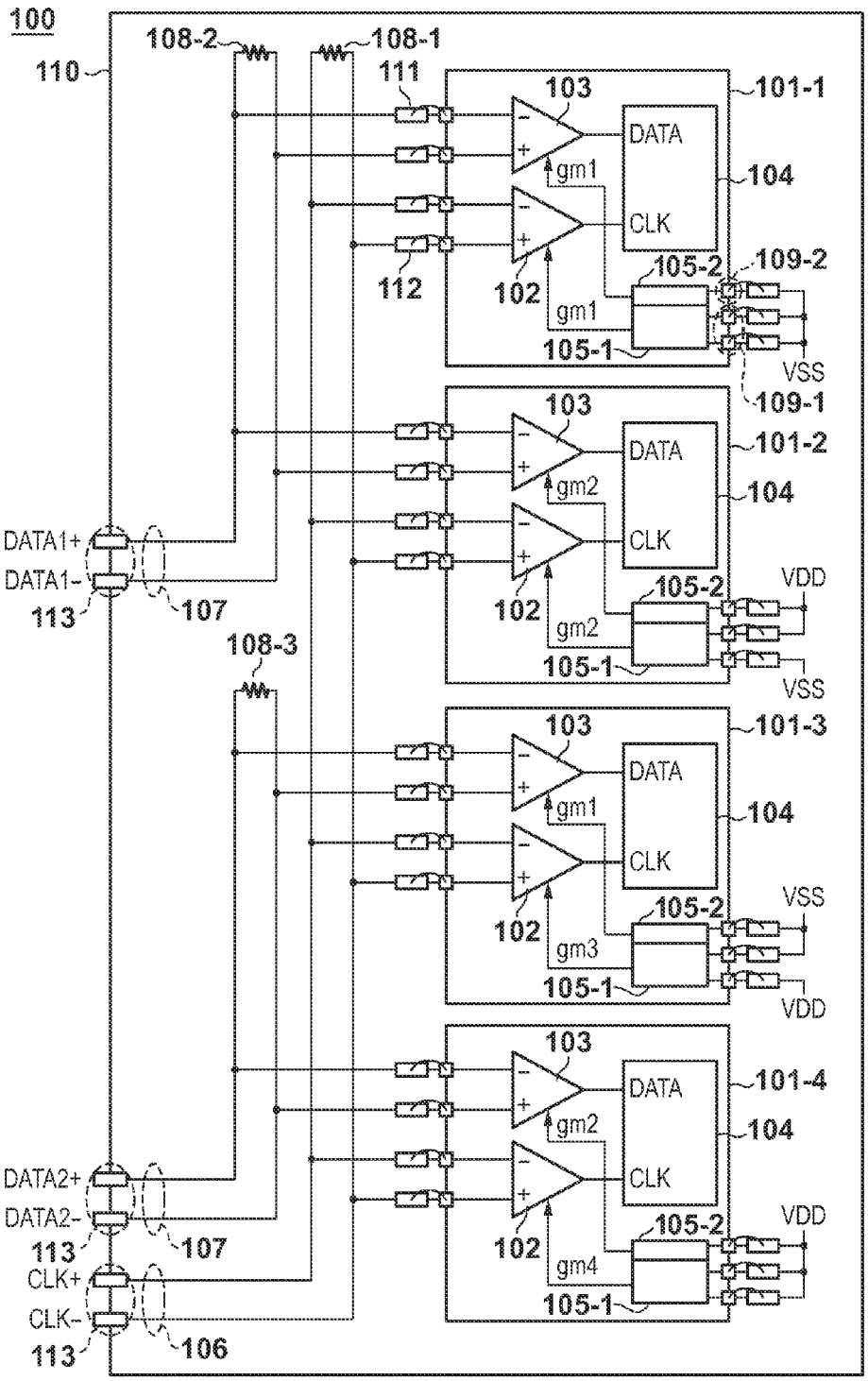
FIG. 12 is a circuit diagram showing the circuit layout and wiring of four element substrates integrated on a printed board according to the second embodiment.
Figure 13:
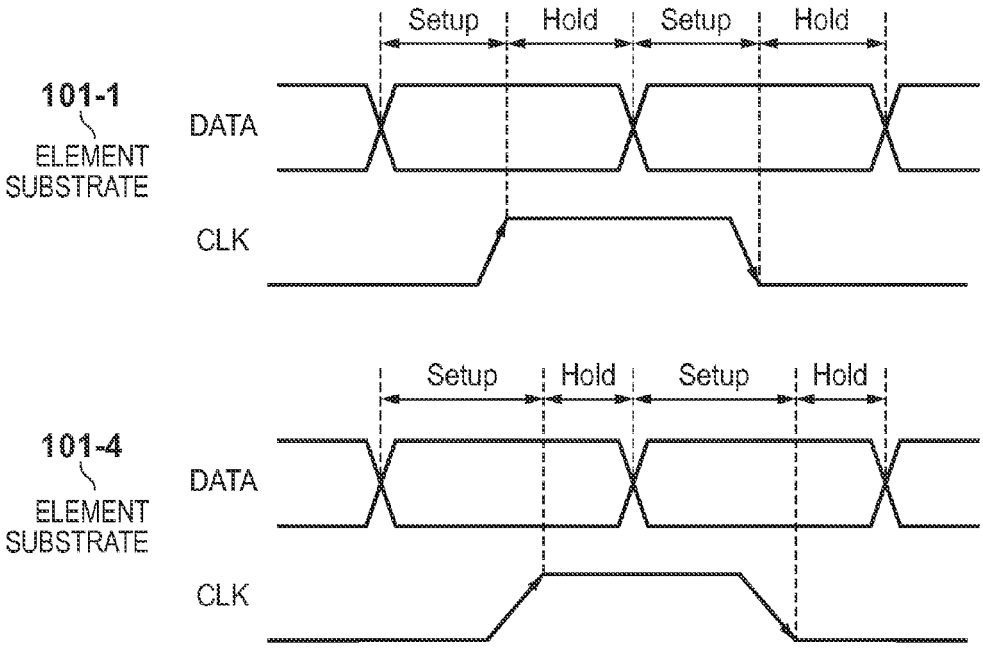
FIG. 13 is a view showing the single-ended waveforms of an image data signal and a clock signal after amplification by reception circuits provided in a plurality of element substrates integrated on a conventional full-line printhead.

FIG. 12 is a circuit diagram showing the circuit layout and wiring of four element substrates integrated on a printed board 110 according to the second embodiment. In this embodiment as well, four element substrates 101 having the same circuit arrangement are arranged on the printed board 110, as in the first embodiment. The same reference numerals and symbols as in the first embodiment denote the same constituent elements and signals in FIG. 12, and a detailed description thereof will be omitted.

The element substrate is different from that of the first embodiment shown in FIG. 7 in that two control circuits 105-1 and 105-2 and control terminals 109-1 and 109-2 corresponding to them are provided in each element substrate.

The wiring of the printed board 110 is different from that of the first embodiment in that two second pairs of signal lines 107 are provided, and image data signals (DATA) are also supplied by the two second pairs of signal lines 107 of one-to-many connection. Hence, since the image data signals (DATA) are also supplied to a plurality of (in this case, two) element substrates, multiple reflection of signals occurs. Hence, the waveform quality deteriorates, and the signal amplitude becomes small. The longer the distance from a terminating resistor 108-2 or 108-3 is, the larger the deterioration of waveform quality caused by the multiple reflection is.

The control circuit 105-1 sets the gain of a first reception circuit 102 based on a 2-bit signal input to the control terminal 109-1. On the other hand, the control circuit 105-2 sets the gain of a second reception circuit 103 based on a 1-bit signal input to the control terminal 109-2. For example, when the logical level of the signal input from the control terminal 109-2 is low level, the gain of the second reception circuit 103 is set low (first level). When the logical level of the signal input from the control terminal 109-2 is high level, the gain of the second reception circuit 103 is set high (second level). In this way, the control circuit 105-2 can set the gain of the second reception circuit 103 in two levels in accordance with the signal input to the control terminal 109-2. In other words, the control circuit 105-2 can be regarded as a setting circuit configured to determine the gain of the second reception circuit 103.

In FIG. 12, a control signal having a signal value "0" is supplied to the control terminal 109-2 of the element substrate 101-1, a control signal having a signal value "1" is supplied to the control terminal 109-2 of the element substrate 101-2, and a control signal having a signal value "0" is supplied to the control terminal 109-2 of the element substrate 101-3. In addition, a control signal having a signal value "1" is supplied to the control terminal 109-2 of the element substrate 101-4. In this way, the gain of the second reception circuit 103 of the element substrate 101-1 is set to the first level, and the gain of the second reception circuit 103 of the element substrate 101-2 is set to the second level. Additionally, the gain of the second reception circuit 103 of the element substrate 101-3 is set to the first level, and the gain of the second reception circuit 103 of the element substrate 101-4 is set to the second level.

With the above-described arrangement, not only the gain of the first reception circuit of the element substrate but also the gain of the second reception circuit can be set higher as the distance from the terminating resistor increases. Even when the image data signals (DATA) are supplied by the pairs of signal lines of one-to-many connection, the same waveform quality can be obtained concerning the image data signal (DATA) and the clock signal (CLK) after amplification by the reception circuits. As a result, a sufficient margin of Setup/Hold time of each signal can be ensured.

For example, in each of the element substrates 101-2 and 101-4 whose distance from the terminating resistor is longest, the gain of the second reception circuit is set high. For this reason, even when the amplitude of the image data signal is small, the waveform quality of the amplified image data signal coincides with that of the clock signal. It is therefore possible to sufficiently ensure the margin of Setup/Hold time of each signal. Especially, the second embodiment is more advantageous than the first embodiment because the second pairs of signal lines 107 are also connected by one-to-many connection, and the number of wirings on the printed board 110 can be reduced.

Two embodiments have been described above. However, the present invention is not limited by them. For example, four element substrates are provided on the printed board 110. However, the number of element substrates is not limited to four, and may be six, eight, 10, or the like. The number of bits of the control signal input to control the gain of the first reception circuit 102 is two. However, the number of bits is not limited to two, and may be one, three, four, or the like. The terminating resistor 108-1 is arranged outside the element substrates but may be arranged in an element substrate.

The above-described element substrates are used in an inkjet full-line printhead. However, the element substrates themselves may be applied to another device. For example, they are applicable to a reading unit configured to read an original image, a display unit configured to display an image, or the like. In this case, the driving elements are not print elements but light-emitting elements such as LEDs or diodes, sensor elements such as CMOS sensors, or the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-096642, filed May 1, 2013, which is hereby incorporated by reference herein in its entirety.

What is claimed is:

1. A base in which a plurality of element substrates each including a plurality of driving elements are arranged in an arrayed direction of said plurality of driving elements, comprising:

a first terminal configured to input a first signal as a differential signal;

a first pair of signal lines configured to transfer the differential signal of the first signal from said first terminal to said plurality of element substrates;

a second terminal configured to input a second signal as a differential signal; and a second pair of signal lines configured to transfer the differential signal of the second signal from said second terminal to said plurality of element substrates, wherein each of said plurality of element substrates includes:

a first amplifier configured to amplify the differential signal of the first signal transferred via said first pair of signal lines;

a second amplifier configured to amplify the differential signal of the second signal transferred via said second pair of signal lines; and a first control circuit configured to control to change a gain of said first amplifier based on a first control signal from outside.

2. The base according to claim 1, wherein each of the first signal and the second signal is supplied from outside as a low voltage differential signal (LVDS).

3. The base according to claim 1, wherein the first signal comprises a signal commonly input to said plurality of element substrates, the second signal comprises a plurality of signals individually input to said plurality of element substrates, and said first pair of signal lines are terminated by a resistor on the base.

4. The base according to claim 3, wherein the gain of said first amplifier included in each of said plurality of element substrates changes depending on a distance from a position where said first pair of signal lines are terminated by the resistor to the corresponding one of said plurality of element substrates, and the gain is set low as the distance becomes short, and high as the distance becomes long.

5. The base according to claim 1, further comprising a second control circuit configured to control to change the gain of said second amplifier based on a second control signal from outside.

6. The base according to claim 5, wherein each of the first signal and the second signal is a signal supplied to some of said plurality of element substrates.

7. A full-line printhead configured to use a base according to claim 1, wherein each of said plurality of driving elements serves as a print element, the first signal is used as a clock signal, and the second signal is used as an image data signal so as to cause a plurality of the print elements to perform printing in a printing width corresponding to a width of a print medium.

8. The full-line printhead according to claim 7, wherein the base and each of said plurality of element substrates has a rectangular shape, said plurality of print elements are arrayed in a longitudinal direction of the element substrates, and said plurality of element substrates are arranged while defining the longitudinal direction of the element substrates as the arrayed direction of said plurality of print elements.

9. The full-line printhead according to claim 8, wherein the full-line printhead is an inkjet printhead configured to print the image by discharging ink to the print medium.

10. A printing apparatus for printing by using an inkjet printhead according to claim 9.

* * * * *